United States Patent [19]

Frey et al.

[11] 4,442,378

[45] Apr. 10, 1984

[54] HIGH PRESSURE SODIUM VAPOR LAMP HAVING RESISTANCE HEATER MEANS

[75] Inventors: Robert G. Frey, Strongsville; Charles I. McVey, Shaker Heights, both of Ohio

[73] Assignee: General Electric Company, Schenectady, N.Y.

[21] Appl. No.: 403,899

[22] Filed: Jul. 30, 1982

[51] Int. Cl.[3] ..... H05B 41/16

[52] U.S. Cl. ..... 315/47; 315/46; 315/73; 315/116; 315/117

[58] Field of Search ..... 315/46, 48–50, 315/5–6, 73, 108, 115–117, 47

[56] References Cited

U.S. PATENT DOCUMENTS 3,851,207 11/1974 McVey ..... 315/49

4,182,976 1/1980 Larson ..... 315/49

*Primary Examiner*—Eugene R. LaRoche

*Attorney, Agent, or Firm*—John F. McDevitt; Philip L. Schlamp; Fred Jacob

[57] ABSTRACT

An improved high pressure sodium vapor lamp is described having resistance heater means contained within a tubular light-transmitting ceramic envelope that further contains a reservoir of sodium-mercury amalgam in excess of the quantity vaporized during lamp operation in order to heat the ceramic envelope before lamp starting and thereby reduce the starting voltage requirements. In the preferred embodiment, said resistance heater means comprises a refractory metal coil wound around the tungsten shank of one thermionic electrode and electrically insulated therefrom and which is supplied with lower current than is subsequently applied to said electrodes for the lamp operation.

15 Claims, 3 Drawing Figures

Fig. 1
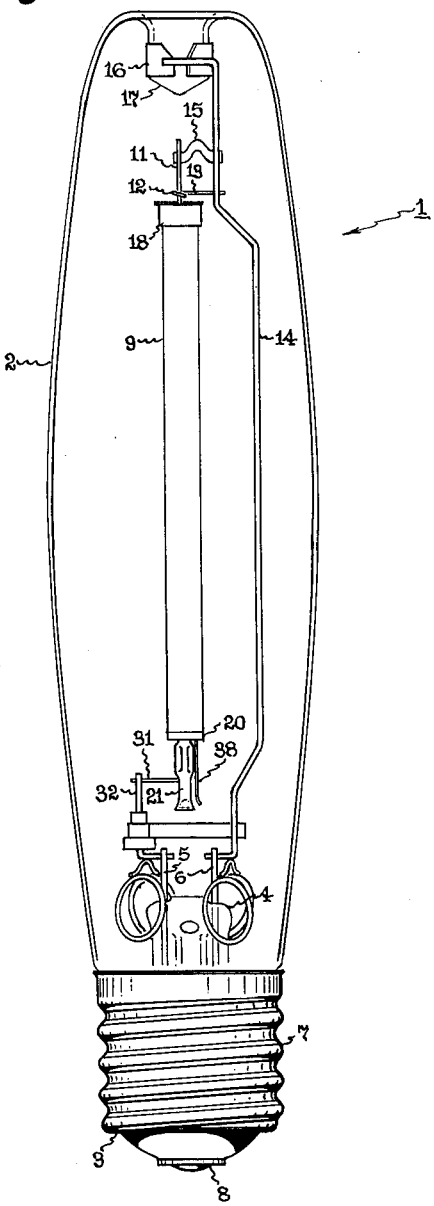
Fig. 2
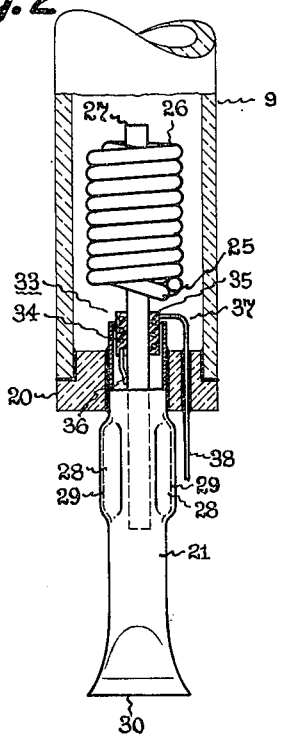
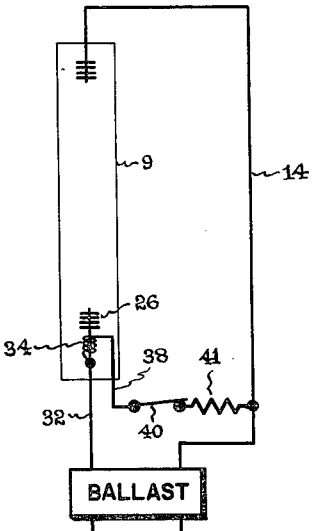
Fig. 3

HIGH PRESSURE SODIUM VAPOR LAMP HAVING RESISTANCE HEATER MEANS

RELATED PATENT APPLICATIONS

In our U.S. patent application No. 403,900, filed contemporaneously with the present application, there is described a high pressure sodium vapor lamp having related resistance heating means.

In our U.S. patent application No. 403,901, also filed contemporaneously with the present application, there is described another high pressure sodium vapor lamp having related resistance heater means.

BACKGROUND OF THE INVENTION

Resistance heater means are already known as the starting aid in high pressure sodium vapor lamps. For example, in U.S. Pat. No. 4,001,634, there is described thermal starter means for this type lamp in the form of a bimetal switch which is located outside the conventional ceramic arc tube and which upon opening responsive to the applied electric current generates an inductive voltage pulse said to be sufficient to inonize the starting gas in the arc tube to start lamp operation. It is also known that the color temperature of high pressure sodium vapor lamp operation varies undesirably with the overall lamp color point depending to a significant degree on the temperature of the cold spot in the arc tube where amalgam condensation takes place. The "cold spot" temperature controls amalgam vapor pressure inside the arc tube thereby increasing or decreasing the amount of vaporized amalgam which produces the visible lamp emission as well as the color of said lamp emission.

Resistance heater means have also been located inside the arc tube of the sodium vapor lamp to stabilize the cold spot temperature and amalgam vapor pressure which tend to rise during lamp operating life. The undesired variation is attributable to operating voltage rise that eventually reaches the ballast sustaining voltage and determines the end of lamp life in this type lamp. Said resistance heater means is supplied with the lamp current which inherently decreases with an increase in the lamp operating voltage and reduces supplemental heating of the amalgam reservoir as the stabilizing mechanism for improved lamp operation. A representative sodium vapor lamp incorporating this type resistance heater means is described in U.S. Pat. No. 3,851,207, wherein the heater element simply comprises an integral part of the thermionic electrode coil. Understandably, the power consumed by such heater means reduces the lamp operating efficiency and this power loss will be greatest at the initial lamp operation. Since the present lamp designs exhibit only a 20 volt rise after 15,000 hours of lamp operation, such loss in lamp operating efficiency seems excessive especially when encountered before any voltage rise takes place.

Accordingly, it would be desirable to provide improved means whereby this type lamp can be started at lower starting voltage requirements. It would also be desirable to do so in a manner which does not add significant cost to the lamp design or its cost of manufacture by a required modification of the lamp ballast circuitry. It would be further desirable to reduce the starting voltage requirements in this type lamp by means which can lower the ballast starting circuitry requirements.

SUMMARY OF THE INVENTION

It has now been discovered that resistance heater means located within the ceramic arc tube adjacent the amalgam reservoir in said electrode structure and supplied with electric current independent of the lamp current can serve to preheat the arc tubes as a means of reducing the starting voltage level for lamp operation. By independently heating the arc tube in this manner before or contemporaneous with the application of electric current to the thermionic electrode, no loss in lamp operating operating efficiency should result due to some power being consumed for supplemental heating at the expense of the lamp operating discharge since the heating is reduced or can be discontinued after the lamp is started. Locating the present resistance heater means adjacent the amalgam reservoir for said arc tube provides a means to increase the amalgam vapor pressure within said arc tube before the lamp operating discharge is established thereby further serving to help with lamp starting. The pressure improvement should also enable lower wattage lamps of this type to be constructed since conventional lamps without supplemental electrode heating have a minimum wattage requirement needed to sustain the lamp operating discharge.

Basically, the presently improved high pressure sodium vapor lamp construction includes a tubular light transmitting ceramic envelope containing a reservoir of sodium-mercury amalgam in excess of the quantity vaporized in the lamp operation and thermionic electrodes being sealed into its ends wherein the improvement comprises further including within said ceramic envelope resistance heater means disposed adjacent the amalgam reservoir and supplied with electric current other than the lamp current which are actuated before or contemporaneous with application of electric current to said electrodes in order to reduce the starting voltage level for lamp operation but which is reduced when the lamp is started. A thermally responsive switch located within the outer vitreous envelope of the lamp but adjacent to the cold spot location in the arc tube provides convenient means to discontinue operation of the resistance heater means after the lamp has been started but which can restart the lamp automatically without having to modify the lamp ballast circuitry. In accordance with the present method of lamp operation, therefore, a first electric current is applied to said resistance heating means sufficient to preheat said thermionic electrodes, then a second electric current is applied to the thermionic electrodes independent from said first electric current causing the lamp operating discharge, and finally, the first electric current is reduced after the lamp operating discharge has occurred.

In accordance with a preferred embodiment, the presently improved high pressure sodium vapor lamp comprises a tubular light-transmitting ceramic tube having closures and thermionic electrodes in its ends, and containing a reservoir of sodium-mercury amalgam in excess of the quantity vaporized during lamp operation along with inert gas, such as xenon, to facilitate starting, one of said closures and thermionic electrodes comprising a tubular metal inlead conductor hermetically sealed to said ceramic tube and externally extending therefrom to provide said amalgam reservoir at its external end and said tubular metal inlead being joined at its opposite end to an electrode located within said ceramic tube mounted on a metal shank, wherein the improvement comprises resistance heater means being disposed adjacent said metal shank and supplied with low level electric current before or contemporaneous with application of electric current to said electrodes in order to reduce the starting voltage level for lamp operation but which is reduced after the lamp is started. The thermionic electrode structures employed in said lamp embodiment comprise refractory metal coils wound around the tungsten shank. The resistance heater means includes a refractory metal coil wound around the tungsten shank and one thermionic electrode but electrically insulated therefrom and which is supplied with less current than the current being supplied to said electrode. One end of said refractory metal coil is electrically connected by direct joinder to said tungsten shank with the other end of said coil being electrically connected to an inlead emerging from the ceramic arc tube. The preferred lamp embodiment further includes an outer evacuated light-transmitting vitreous envelope surrounding said ceramic tube having a stem press seal at one end through which extend a pair of inleads electrically connected to said thermionic electrodes along with inlead means for the resistance heater means. The inlead electrically connected to one end of the refractory metal coil providing the resistance heating further extends to circuit means in the outer vitreous envelope for an independent supply of electric current thereto.

BRIEF DESCRIPTION OF THE DRAWINGS

FIG. 1 shows a high pressure sodium vapor lamp embodying the presently improved resistance heating means;

FIG. 2 is an enlarged detailed view of the exhaust tube electrode member incorporating said resistance heater means; and FIG. 3 is a schematic electrical circuit to operate said resistance heater means before the lamp operation is established.

DETAILED DESCRIPTION OF THE PREFERRED EMBODIMENTS

Referring to FIG. 1, a high pressure sodium vapor lamp 1 corresponding to a 400 watt size is illustrated which comprises a vitreous outer envelope 2 having a standard mogul screw base 3 attached to one end and comprising a reentrant stem press seal 4 through which extend, in conventional fashion, a pair of relatively heavy lead-in conductors 5 and 6 whose outer ends are connected to the screw shell 7 and eyelet 8 of the base. The inner envelope or arc tube 9 centrally located within said outer envelope comprises a length of light-transmitting ceramic tubing, preferably polycrystalline alumina ceramic which is translucent or which can be single crystal alumina which is clear and transparent. The upper end of the arc tube is closed by a conventional ceramic end closure through which extends a niobium inlead wire 11 hermetically sealed. Said inlead supports the upper electrode which may be generally similar to the lower electrode illustrated in FIG. 2. A preferred upper end closure and electrode support structure is described in U.S. Pat. No. 4,034,252, also assigned to the assignee of the present invention. The external portion of inlead 11 passes through a loop 12 and transverse support wire 13 attached to a side rod 14. This arrangement allows for thermal expansion of the arc tube during lamp operation when the lower end seal is rigidly fixed in place, and a resilient metal ribbon 15 assures continued good electrical connection. A metal reflector band 18 may be desirable around the upper end of the arc tube to help in maintaining a higher electrode operating temperature, particularly in smaller sizes of lamps such as 250 watts or less. The lower end closure in electrode support assembly 20 for said lamp has a central aperture through which extends a thin-walled niobium tube 21 serving as an exhaust tube and as an inlead. Said tube extends but a short distance through the ceramic end closure and is hermetically sealed therethrough by sealing frit in the conventional manner. The closed arc tube is supported in the outer envelope by a connector 31 which is welded across from tubular inlet 21 to a support rod 32 joined to lead-in conductor 5. A second lead-in conductor 38 shown emerging from said lower end closure and connected to the resistance heater means contained within the arc tube further extends to the circuitry later described in FIG. 3 to provide an independent current source from the lamp current. Also now shown in the present drawing is a filling of xenon gas within the arc tube to help establish the lamp operating discharge.

The present invention resides in the resistance heater means itself which is depicted in greater detail for the lower electrode structure and the electrode support assembly therefor as shown in FIG. 2. Specifically, said electrode proper comprises two layers of tungsten wire 25 and 26 wound around the distal end of a tungsen shank 27 and located within the ceramic envelope. The shank extends far enough down into the tube or inlead 21 so that it can be securely locked in place by deforming the tube in a place outside the ceramic envelope by pinching the shank over an appreciable length. Preferably, the deformation is at an intermediate point in the tube which leaves a portion beyond it adequate to serve as a reservoir for excess amalgam. The illustrated crimp, sometimes known as a butterfly crimp, is of such a character that it pinches the shank along the entire length of the flattened portions or wings 28. At the same time, restrictive channels 29 are left on both sides of the shank which communicate with the outer portion of the exhaust tube to the tip 30. They allow passage of the sodium-mercury amalgam in vapor form but prevent its movement as a liquid under ordinary operating conditions, even when a lamp is upended. Depicted resistance heater means 33 comprises a refractory metal coil 34 wound around the tungsten shank 27 and electrically insulated therefrom with ceramic sealing frit 35. One end 36 of said refractory metal coil 34 is directly secured to the tungsten shank 27, such as by welding and the like, with the remaining end 37 of said refractory metal coil being electrically connected to an inlead 38 emerging from said arc tube.

A schematic electrical circuit having representative components to automatically operate the present resistance heater means prior to establishing the lamp operating discharge is shown in FIG. 3. As depicted, the circuit connections to the upper and lower thermionic electrodes from conventional ballast member 39 are made by conductors 14 and 32, respectively, in a manner permitting electrical current to be supplied to the refractory metal coil 34 of the present resistance heater means before supplying electric current to the thermionic electrodes. This occurs, as previously explained, by having one end of the refractory metal coil directly connected to the tungsten shank of lower thermionic electrode 26 with the remaining end of said refractory metal coil being electrically connected to inlead 38. By further terminating said inlead 38 as shown to the electrical conductor 14, there is provided a circuit means to actuate said refractory metal coil 33 before the lamp operating discharge has been established in the customary manner. More particularly, there is positioned in the outer vitreous envelope of said lamp a conventional normally closed thermally responsive switch 40 sufficiently proximate to the arc tube 9 to open after said arc tube has been heated to some elevated temperature by the present resistance heater means. A series electrical connection of this switch and resistor 41 in the branch circuit formed with inlead 38 provides the means to supply electric current at a low level to heat said refractory metal coil before the switch is opened.

It will be apparent from the foregoing description that resistance heater means have been provided for high pressure sodium vapor type lamps which is generally useful. It will be further apparent to those skilled in the lamp art, however, that said improvement can be incorporated in other type sodium vapor lamps than above specifically disclosed. For example both designs utilizing additional gettering and starting aids could use the present resistor heater means to its advantage. Accordingly it is intended to limit the present invention only by the scope of the following claims.

What we claim as new and desired to secure by United States Letters Patent is:

1. An improved high pressure sodium vapor lamp having a tubular light-transmitting ceramic envelope containing a reservoir of sodium-mercury amalgam in excess of the quantity vaporized during lamp operation and thermionic electrodes being sealed into its ends, wherein the improvement comprises further including within said ceramic envelope resistance heater means including a resistive heating element disposed adjacent said reservoir of sodium-mercury amalgam and electrically connected with respect to said electrodes to be supplied with electric current other than the lamp current which is actuated before the lamp operating discharge is established between said electrodes in order to reduce the starting voltage level for lamp operation but which is reduced when the lamp is started.

2. An improved lamp as in claim 1 wherein said resistance heater means are controlled by a thermally responsive switch.

3. An improved lamp as in claim 1 wherein the thermionic electrodes comprise refractory metal coils wound around a tungsten shank.

4. An improved lamp as in claim 3 wherein said resistance heater means comprises a refractory metal coil wound around the tungsten shank of one electrode and electrically insulated therefrom.

5. An improved lamp as in claim 4 wherein the refractory metal coil is electrically connected at one end to said tungsten shank and electrically connected at the other end to an inlead emerging from the ceramic envelope.

6. An improved lamp as in claim 5 wherein a thermally responsive switch is electrically connected to said inlead emerging from the ceramic envelope to serve as the means of controlling said resistance heater means.

7. An improved high pressure sodium vapor lamp comprising:

(a) a light-transmitting ceramic tube having a thermionic electrode sealed into each end and a reservoir of sodium-mercury amalgam in excess of the quantity vaporized during lamp operation along with inert gas to facilitate starting;

(b) an evacuated outer light-transmitting vitreous envelope surrounding said arc tube having a stem press seal at one end through which extends a pair of inleads electrically connected to said thermionic electrodes;

(c) one of said thermionic electrodes comprising a tubular metal inlead conductor hermetically sealed to said ceramic tube and extending externally therefrom to provide said amalgam reservoir at its external end and said tubular metal inlead being joined at its opposite end to an electrode located within said ceramic tube mounted on a metal shank;

(d) wherein the improvement comprises further including within said ceramic tube resistance heater means including a resistive heating element being disposed adjacent said reservoir of sodium-mercury amalgam and electrically connected with respect to said electrodes to be supplied with electric current at a lower value than the lamp current which is actuated before the lamp operating discharge is established between said electrodes in order to reduce the starting voltage level for lamp operation but which is reduced when the lamp is started.

8. An improved lamp as in claim 7 wherein said resistance heater means are controlled by a thermally responsive switch located within said outer vitreous envelope.

9. An improved lamp as in claim 7 wherein both thermionic electrodes comprise refractory metal coils wound around a tungsten shank.

10. An improved lamp as in claim 9 wherein said resistance heater means comprises a refractory metal coil wound around the tungsten shank of one thermionic electrode and electrically insulated therefrom.

11. An improved lamp as in claim 10 wherein the refractory metal coil is electrically connected at one end to said tungsten shank and electrically connected at the other end to an inlead emerging from the ceramic tube.

12. An improved lamp as in claim 11 wherein a thermally responsive switch is electrically connected to said inlead emerging from the ceramic tube to serve as the means of controlling operation of said resistance heater means.

13. An improved method of operating a high pressure sodium vapor lamp having a light-transmitting ceramic envelope containing a reservoir of sodium-mercury amalgam in excess of the quantity vaporized during lamp operation and thermionic electrodes being sealed into its ends which comprises:

(a) applying a first electric current to resistance heating means disposed in said ceramic envelope sufficient to preheat said thermionic electrodes;

(b) applying a second electric current independent from said first electric current sufficient to produce the lamp operating discharge; and (c) reducing the first electric current when the lamp operating discharge has been established.

14. An improved method as in claim 13 wherein the second electric current is applied by thermally responsive circuit means.

15. An improved method of operating a high pressure sodium vapor lamp having a light-transmitting ceramic tube with closures and thermionic electrodes at each end and containing a reservoir of sodium-mercury amalgam in excess of the quantity vaporized during lamp operation along with inert gas to facilitate starting, one of said closures and thermionic electrodes comprising a tubular metal inlead conductor hermetically sealed to said ceramic tube and externally extending therefrom to provide said amalgam reservoir at its external end and said tubular metal inlead being joined at its opposite end to an electrode located within said ceramic tube of a refractory metal shank which comprises:

(a) applying electric current to resistance heating means disposed in said arc tube adjacent said refractory metal shank sufficient to preheat said thermionic electrodes;

(b) actuating thermally responsive circuit means to discontinue supplying electric current to said resistance heating means; and (c) concurrently supplying electric circuit to said thermionic electrodes in order to establish the lamp operating discharge therebetween.

* * * * *